US005088846A

United States Patent [19]

Yamaguchi

[11] Patent Number: 5,088,846

[45] Date of Patent: Feb. 18, 1992

[54] PRINTER OF RIBBON CASSETTE FIXED TYPE

[75] Inventor: Kouzou Yamaguchi, Kashihara, Japan

[73] Assignee: Sharp Kabushiki Kaisha, Osaka, Japan

[21] Appl. No.: 531,239

[22] Filed: May 31, 1990

Related U.S. Application Data

[60] Continuation-in-part of Ser. No. 415,594, Oct. 2, 1989, abandoned, which is a division of Ser. No. 181,315, Apr. 13, 1988, abandoned.

[30] Foreign Application Priority Data

Apr. 13, 1987 [JP] Japan ..... 62-90412

[51] Int. Cl.[5] ..... B41J 35/28

[52] U.S. Cl. ..... 400/208; 400/207; 400/248.1

[58] Field of Search ..... 400/207, 208, 208.1, 400/248.2, 248.1, 250, 233, 234, 236, 194, 195, 196, 196.1, 692

[56] References Cited

U.S. PATENT DOCUMENTS

| | | | |
|---|---|---|---|
| 4,000,804 | 1/1977 | Zaltieri | 400/208 |
| 4,264,224 | 4/1981 | Mathews | 400/235 |
| 4,396,305 | 8/1983 | Shattuck et al. | 400/208 |
| 4,420,268 | 12/1983 | Tsukamura et al. | 400/233 |
| 4,563,100 | 1/1986 | Hamamichi | 400/208 |
| 4,577,198 | 3/1986 | Saiki et al. | 346/76 PH |
| 4,611,937 | 9/1986 | Sato et al. | 400/208 |
| 4,621,270 | 11/1986 | Mizutani et al. | 400/208 |
| 4,624,592 | 11/1986 | Purcell | 400/208 |
| 4,712,933 | 12/1987 | Natsume | 400/208 |
| 4,750,008 | 6/1988 | Matsuura | 400/208 |
| 4,867,586 | 9/1989 | Shimoyama | 400/208 |
| 4,952,086 | 8/1990 | Yamaguchi | 400/208 |

FOREIGN PATENT DOCUMENTS

| | | | |
|---|---|---|---|
| 287351 | 10/1988 | European Pat. Off. . | |
| 3712114 | 10/1987 | Fed. Rep. of Germany | 400/692 |
| 57-201675 | 12/1982 | Japan . | |
| 58-217384 | 12/1983 | Japan . | |
| 59-9083 | 1/1984 | Japan . | |
| 60-120085 | 6/1985 | Japan . | |
| 256675 | 11/1987 | Japan | 400/692 |
| 2058719 | 4/1981 | United Kingdom . | |
| 2089734 | 6/1982 | United Kingdom . | |

OTHER PUBLICATIONS

IBM Technical Disclosure Bulletin, "Off-The-Carrier Ribbon Feed" by R. W. McCornack, vol. 27, No. 4A, Sep. 1984, pp. 2292-2293.

*Primary Examiner*—Edgar S. Burr
*Assistant Examiner*—Joseph R. Keating

[57] ABSTRACT

A printer of a ribbon cassette fixed type, to which a ribbon cassette is detachably mounted, has a main body and a cassette mounting portion provided on the main body. The mounting portion has a cassette loading plate for loading the cassette thereon. The cassette includes two spools in parallel winding an ink ribbon therebetween. The printer includes a feed reel disposed at the loading plate and adapted to engage with one of the spools for feeding the ribbon, and a take-up reel disposed at the loading plate and adapted to engage with the other of the spools for taking-up the ribbon. A carriage is mounted in the main body movably along a printing direction. A print head is disposed on the carriage, to which a portion of the ribbon is set, for printing by using the ribbon discharged from the cassette by a movement of the carriage in the printing direction. The printer further includes a moving device provided to the mounting portion for moving the loading plate to a loading position, in which the cassette is positioned in a vicinity of the carriage so as to set the portion of the ribbon to the head along with a loading motion of the cassette, and an operating position, in which the cassette is positioned away from the carriage so as not to disturb the movement of the carriage.

8 Claims, 6 Drawing Sheets

PRINTER OF RIBBON CASSETTE FIXED TYPE

CROSS-REFERENCE TO RELATED APPLICATION

This application is a Continuation-In-Part application of U.S. Ser. No. 415,594 filed on Oct. 2, 1989, now abandoned, which is the divisional application of U.S. Ser. No. 181,315 filed on Apr. 13, 1988, now abandoned.

BACKGROUND OF THE INVENTION

1. Field of the Invention

This invention relates to a printer, and more particularly to a printer such as an electro-thermic printer which has a ribbon cassette mounted in a stationary state independently of the carriage. The ribbon cassette lets off the ink ribbon from the ribbon cassette and recovers it into the ribbon cassette by means of a print head mounted on the carriage along with the reciprocal motion of the carriage in the printing direction.

2. Description of the Related Arts

The conventional printer using an ink ribbon was generally composed so as to mount the ribbon cassette on the carriage together with the print head, but the weight of the entire carriage was increased by mounting the ribbon cassette and ribbon take-up mechanism, and it was hard to move the carriage at high speed. Besides, in order to move this heavy carriage at high speed, a driving motor of a high output torque was required, and in this respect, too, the size of the carriage was enlarged, and the ribbon cassette that could be mounted on the carriage was limited accordingly.

As a means of solving these problems, meanwhile, a new mechanism was proposed in the Japanese Laid-open Patent Publication No. 58-217384. In this printer, structurally, the ribbon cassette is mounted in a stationary state independently of the carriage, and along with the reciprocal motion of the carriage in the printing direction, the ink ribbon is let off from the ribbon cassette by the print head mounted on the carriage, and is recovered into the carriage.

This printer, however, of the ribbon cassette fixed type involves the following technical problems that must be solved. That is, although the carriage can be reduced in size and weight and can be moved at high speed because the ribbon cassette is not mounted on it, but when transferring the ink ribbon, whenever the carriage is returned to the initial printing position (home position), a friction member for pressing and fixing the ink ribbon to the platen at the initial printing position is separated from the platen, and the take-up side reel is rotated in the take-up direction, and the unused ink ribbon for the portion of the length to record while the carriage makes one reciprocal stroke is preliminarily taken up on the take-up side reel. Consequently, the friction member presses and fixes the ink ribbon to the platen by means of a driving source such as magnet to define the let-off of the ink ribbon from the feed side reel, and the carriage moves in the printing direction, and along with this movement, the unused ink ribbon which has been previously taken up is let off from the take-up side reel, and is printed by the print head, and when returning as the carriage reaches the end of the printing direction, the used ink ribbon is taken up by the take-up side reel, and the same operation is repeated.

Thus, since the ink ribbon in the length necessary for one reciprocal stroke of the carriage is preliminarily taken up on the take-up side reel and the initial printing portion of this ink ribbon is fixed by the friction member, if non-printing blank portions occur continuously in the printing process, the print head is released from the ink ribbon, but these portions remain unused, and are taken up on the take-up side reel when returning the carriage. That is, since the action generally known as ribbon skip cannot be effected, the ink ribbon is consumed needlessly. Moreover, since the ink ribbon in the printing length by one reciprocal stroke of the carriage is preliminarily taken up on the take-up reel side whenever the carriage comes to the initial printing position, it is extremely inefficient, and the take-up diameter of the ink ribbons on both reels changes every moment as the ink ribbon is taken up from the feed side reel to the take-up side reel, so that the rotation control of the motor for taking up the ink ribbon preliminarily on the take-up side reel is very difficult.

In such a printer of the ribbon cassette fixed type as described above, the carriage moves while the cassette is fixed while other functions are to be achieved as a printer. This structure is rather complicated compared with the printer of the ribbon cassette moving type. Consequently, the cassette loading operation, in which the ribbon is to be properly set to the carriage in such a structure, tends to be also complicated. In such a printer of the ribbon cassette fixed type, on one hand, the carriage and the cassette are better to be positioned closer to each other for easily setting the ribbon to the carriage generally in its loading operation, but on the other hand, the cassette can not be positioned so close to the carriage as to disturb the movement of the carriage in its printing operation.

SUMMARY OF THE INVENTION

It is hence an object of the present invention to provide a printer of the ribbon cassette fixed type, in which the cassette can be loaded easily.

According to the present invention, the above object can be achieved by a printer, to which a ribbon cassette is detachably mounted. The cassette includes two spools in parallel winding an ink ribbon therebetween. The printer includes a main body and a cassette mounting portion provided on the main body. The mounting portion has a cassette loading plate for loading the cassette thereon. The printer includes a feed reel disposed at the loading plate and adapted to engage with one of the spools for feeding the ribbon, and a take-up reel disposed at the loading plate and adapted to engage with the other of the spools for taking-up the ribbon. A carriage is mounted in the main body movably along a printing direction. A print head is disposed on the carriage, to which a portion of the ribbon is set, for printing by using the ribbon discharged from the cassette by a movement of the carriage in the printing direction. The printer further includes a moving device provided on the mounting portion for moving the loading plate to a loading position, in which the cassette is positioned in a vicinity of the carriage so as to set the portion of the ribbon to the head along with a loading motion of the cassette, and an operating position, in which the cassette is positioned away from the carriage so as not to disturb the movement of the carriage.

According to the present invention, since the cassette loading plate is moved, by the moving device, to the loading position, in which the cassette is positioned in a vicinity of the carriage so as to set the portion of the ribbon to the head along with a loading motion of the cassette, a cassette loading operation can be performed easily just by loading the cassette on the loading plate, without, for example, pulling-out the ribbon from the cassette and interposing or hooking the ribbon somewhere in the carriage.

After this loading operation, the cassette loading plate is moved, by the moving device, to the operating position, in which the cassette is positioned away from the carriage so as not to disturb the movement of the carriage, then a proper printing operation can be performed with the print head on the carriage by using the ribbon discharged from the cassette by the tensile force of the ribbon set to the head generated by the movement of the carriage in the printing direction.

Accordingly, a printer of the ribbon cassette fixed type can be achieved, in which the cassette can be loaded easily.

In one aspect of the present invention, the head is preferably adapted to pivot on the carriage to one position, in which the ribbon can be set to the head along with the loading motion of the cassette when the loading plate is in the loading position, and another position, in which the head is ready to print by using the ribbon when the loading plate is in the operating position. Accordingly, the ribbon can be set properly to the head just by loading the cassette, while the head can be ready to print by pivoting when the loading plate is in the operating position.

In another aspect of the invention, the printer further includes a reel control device connected with the reels for applying a small torque, of such an extent to slip with respect to a ribbon discharging force generated by the movement of the carriage in the printing direction, to each of the reels at every printing action in such a direction as to wind the ribbon on each of the spools, and applying a large torque to each of the reels at a carriage returning action in such a direction as to wind the ribbon on each of the spools. Accordingly, the ribbon is prevented from slacking at each printing action by the effect of the small torque, while the ribbon is taken-up to the cassette at the carriage returning action by the effect of the large torque.

In another aspect of the present invention, the printer further includes a pair of control rollers, disposed on the carriage and adapted to separate from each other and approach each other to pinch the ribbon therebetween, for transferring and fixing the ribbon therebetween by controlling a rotation thereof, the rollers being adapted such that the ribbon can be set between the separated rollers along with the loading motion of the cassette when the loading plate is in the loading position, and the ribbon is pinched between the rollers when the loading plate is in the operating position. Accordingly, the ribbon can be still easily set to the carriage equipped with the rollers which has a function of controlling the amount of the ribbon transferred to the head. In this case, it is also preferable that the rollers are adapted to transfer the ribbon in a length corresponding to the movement of the carriage in the printing direction by rotating at every printing action and fix the ribbon therebetween by non-rotating at a carriage returning action and a ribbon skipping action. Accordingly, only the necessary amount of the ribbon is transferred to the head for every printing, while no ribbon is transferred to the head in case of a non-printing portion, effecting the ribbon skipping action, and also no ribbon is transferred to the head at the carriage returning action, so as to save the ribbon efficiently.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 to FIG. 13C refer to one of the embodiments of a printer of this invention, in which:

FIG. 1 is a schematic plan view of essential parts;

FIG. 2 is a schematic plan view showing the entire printing mechanism;

FIG. 3 to FIG. 5 are schematic plan views in the printing action, ribbon skip and carriage return, respectively;

FIG. 7 is a timing chart including graphs of printing motor, head motor, ribbon control motor, and paper feed motor;

FIG. 8 is a schematic plan view showing the moving parts of the carriage and the cassette mounting portion in one state;

FIG. 9 is a schematic plan view showing the ribbon transmitting and gripping mechanism;

FIG. 10 is a schematic plan view showing the same as FIG. 8 in another state;

FIG. 11 is a schematic cross-sectional view showing the reel driving mechanism; and FIG. 12 is a plan view of the clutch in FIG. 11; and FIGS. 13A to 13C are schematic cross-sectional views showing the retracting mechanism of the cassette mounting portion.

DETAILED DESCRIPTION OF THE EMBODIMENT

Figure 1:
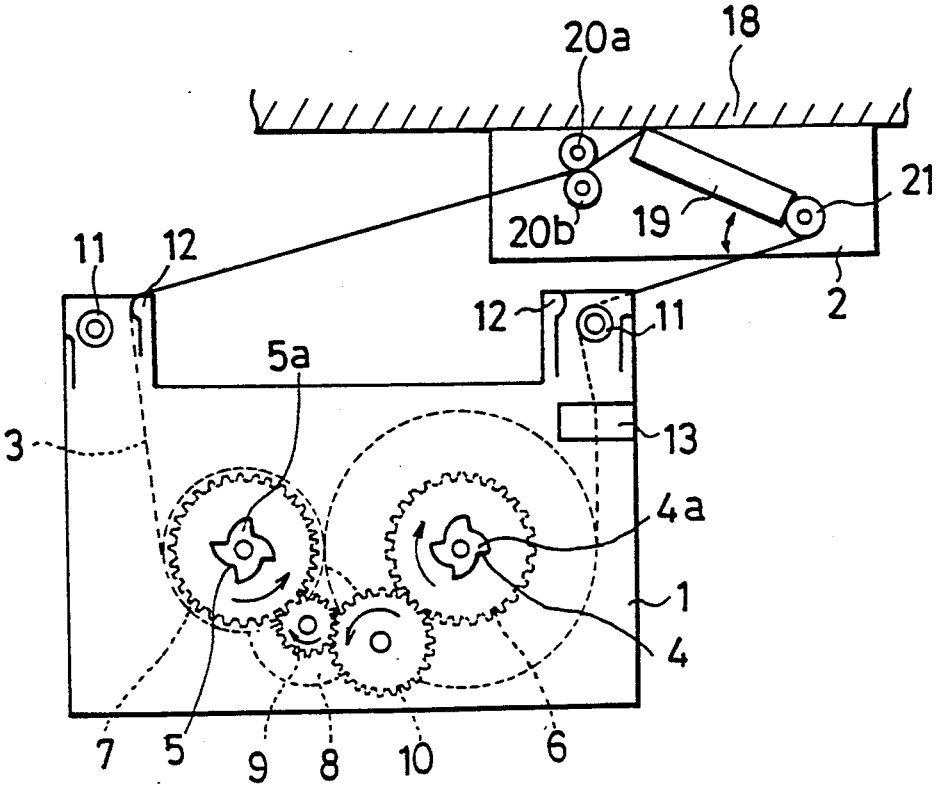

A preferred embodiment of this invention is described in detail below while referring to the drawings.

Figure 2:
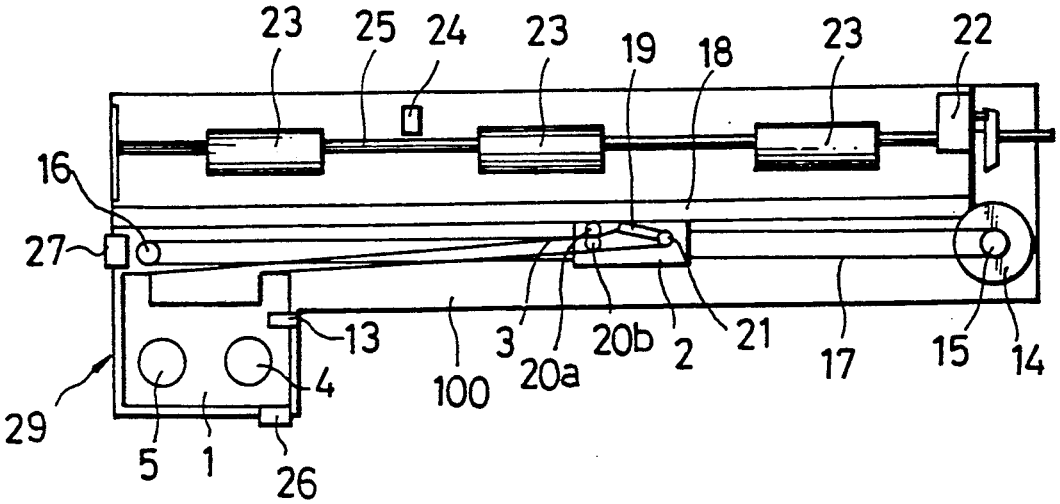

FIG. 1 is a schematic plan view of a ribbon cassette 1 and a carriage 2 which are essential parts of this invention, and FIG. 2 is a schematic drawing showing the entire printing mechanism. In these drawings, a feed reel 4 and a take-up reel 5 of an ink ribbon 3 are disposed parallel, and gears 6, 7 are affixed to these reels 4, 5 as their control mechanism. A prime gear 9 mounted on a motor shaft of a ribbon control motor 8 is meshed with the take-up side gear 7, and the rotation of the prime gear 9 is transmitted to the feed side gear 6 by way of a transmission gear 10. By the rotation of the prime gear 9 by the ribbon control motor 8 in the arrow direction in FIG. 1, a rotating force is provided in the take-up rotating direction indicated by the arrow in the same drawing, on the both reels 4, 5 through the transmission gear 10, and the feed and take-up side gears 6, 7. This rotating force is, in printing action, a small torque so as to slip with respect to the draw-out force by a print head which is described below, and becomes a large torque when the carriage 2 returns. The reel torque is set so that the take-up side is larger than the feed side.

This ribbon cassette 1 is mounted in a stationary state being independent of the carriage 2, on a cassette mounting portion 29 provided on a specified plate 100 of the printer main body as shown in FIG. 2, and is detachable from the cassette mounting portion 29.

The ribbon cassette 1 includes two spools in parallel each having an axial hole (not shown) with which each of the reels 4 and 5 is engaged. The reels 4 and 5 are provided with fingers 4*a* and 5*a* as shown in FIG. 1 while the axial holes of the spools are provided with projections at the inner circumference which engages with the fingers 4*a* and 5*a* ensures the rotation of the reels 4 and 5 are transmitted to the spools of the ribbon cassette 1.

This ribbon cassette 1 can be used on both face and back sides, being in a symmetrical configuration having a guide roller 11 for smoothly leading out the ink ribbon outside and a guide part 12 disposed at right and left symmetrical positions, and the ribbon pancake is exchangeable. A ribbon end sensor 13 is provided at a specified position.

On the carriage 2, as shown in FIG. 2, a timing belt 17 wound on a prime side pulley 15 mounted on a printing motor 14 and a guide pulley 16 is applied, and the carriage 2 is moved reciprocally in the printing direction along a flat platen 18 by turning of this timing belt 17. This carriage 2 is provided with, for example, a print head 19 having a specified number of heating elements disposed in a matrix form and a pair of control rollers 20*a*, 20*b* and a guide roller 21. The print head 19 is disposed so as to be freely rotatably in the arrow direction by a head motor (not shown) located beneath the carriage from one end as the fulcrum, and a printing electrode part composed of said specified number of heating elements is provided at this free end. The pair of control rollers 20*a*, 20*b* are controlled in rotation so as to feed the ink ribbon 3 by the portion corresponding to the printing length in the direction to the take-up side reel 5 at every printing action of the print head 19 to the recording paper.

Three feed rollers 23 rotated by a paper feed motor 22 are attached to the flat platen 18, and a paper end sensor 24 for detecting the end of recording paper sent by each feed roller 23 is provided near a roller shaft 25 of the feed roller 23, and moreover a cassette detection switch 26 to detect whether the ribbon cassette 1 is set in place or not, and a home position switch 27 to detect the return state of the carriage 2 to the initial printing position are disposed at specified positions.

The operation of the embodiment is explained below while referring to FIG. 3 to FIG. 7.

Figure 6A:
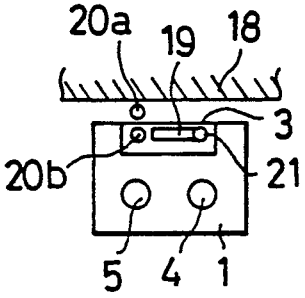
FIGS. 6A to C are diagrams to show the relationship between ribbon cassette and carriage.
Figure 6B:
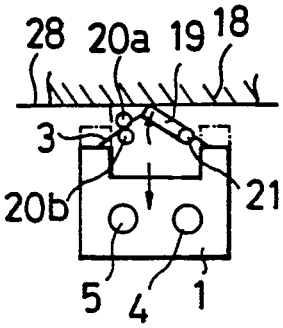

Referring first to FIG. 6, the relation between the ribbon cassette 1 and carriage 2 is explained. When loading the ribbon cassette 1 to the cassette mounting portion of the printer main body, as shown in FIG. 6A, the both control rollers 20*a*, 20*b* are spaced from each other at the carriage 2, and the print head 19 is also released from the platen 18, and when the ribbon cassette 1 is loaded, the ink ribbon 3 is inserted between the both control rollers 20*a*, 20*b*. When this ribbon cassette 1 is set in the cassette mounting portion of the printer main body it is detected by the cassette detection switch 26, and the print head 19 turns in the arrow direction as shown in FIG. 6B, and its printing electrode part contacts with the printing paper 28 by way of the ink ribbon 3, while the control roller 20 in the upper position moves to the lower position as indicated by the arrow so as to pinch the ink ribbon 3 by the both control rollers 20*a*, 20*b*, and at the same time the ribbon cassette 1 is moved from the position indicated by chain line to the position indicated by solid line, thereby resulting in printing set state. The structure of the cassette mounting portion and the carriage for initial loading of the ribbon cassette 1 will be explained more detail later.

Figure 6C:
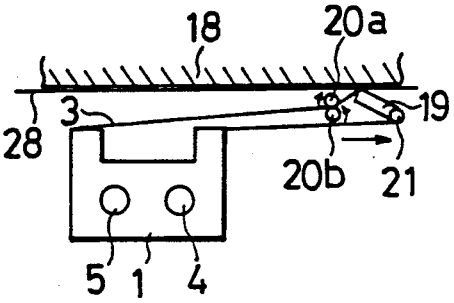

When a printing operation is done, the carriage 2 on which the print head 19 and control rollers 20*a*, 20*b* are mounted is ready to move because the ribbon cassette 1 moves, and is moved in the printing direction, rightward in the drawing as shown in FIG. 6C.

Figure 7:
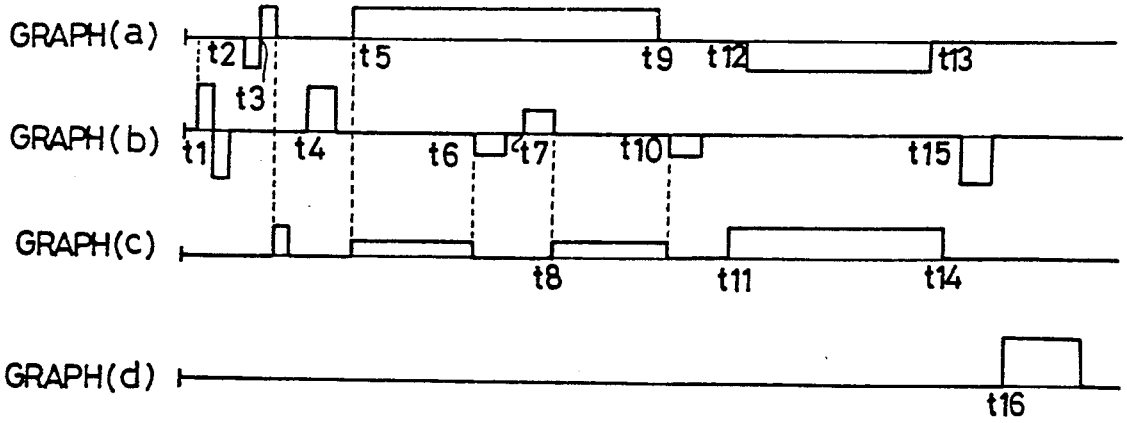

The operation is further described below by referring to the timing charge in FIG. 7. When the power is turned on at time t1 in the graph (b), the head motor rotates the print head 19 in the direction to contact with the platen 18 as shown in the graph (b), and immediately the print head 19 is rotated in the direction to be separated from the platen 18. After the printing electrode part of the print head 19 is thus released from the ink ribbon 3, at time t2, the printing motor 14 is rotated reversely as shown in the graph (a), and the carriage 2 is moved toward the initial printing position, and, at time t3, when the carriage 2 returns to the initial printing position, the printing motor 15 slightly rotates in normal direction to set the carriage 2 in the specified initial printing position. At the same time, as shown in the graph (c), the ribbon control motor 8 is rotated to move the ink ribbon 3 by a specified length. Then, at time t4, the head motor rotates to move the print head to the platen 18 side, and the print head 19 is pressed on the recording paper 28 through the ink ribbon 3, so as to be ready to print.

Figure 3:
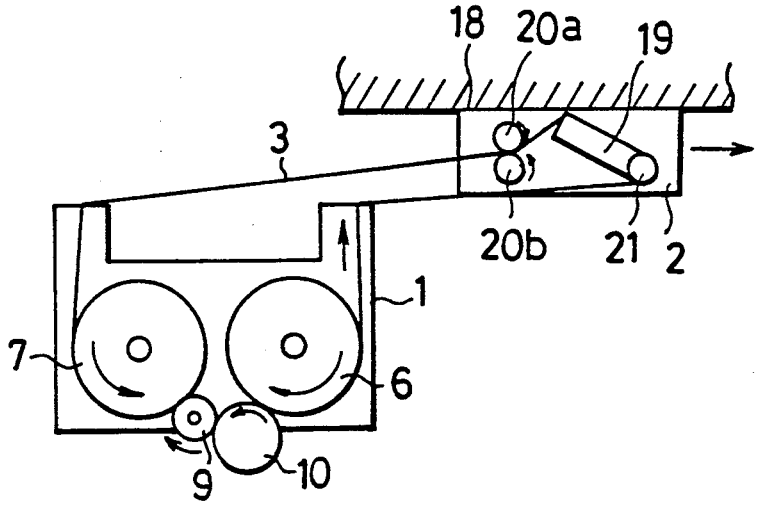

At time t5, printing action is started, and the printing motor 14 is put in normal rotation as shown in the graph (a), and the carriage 2 moves in the printing direction as shown in FIG. 3. At this time, a rotating force in the arrow direction in the drawing is applied to the prime gear 9 by means of the ribbon control motor 8, and the feed side and take-up side gears 6, 7 are rotated in the direction to take up the ink ribbon 3 as indicated by the arrow in the same drawing. However, as shown in the graph (c), since only a small voltage of about half of rating is applied to the ribbon control motor 8, the reel torques of the both reels 4, 5 are small, and are effective to apply tension to the ink ribbon 3 so that the ink ribbon 3 can run stably and remain taut. Besides, at every printing action by the print head 19, the both control rollers 20*a*, 20*b* rotate in the arrow direction in FIG. 3 to transfer the ink ribbon 3 by the portion corresponding to the printing length in the direction to the take-up reel 5, and when not printing, that is, when the carriage 2 moves, the ink ribbon 3 is held and fixed to draw out the ink ribbon 3 from between the both reels 4, 5.

Figure 4:
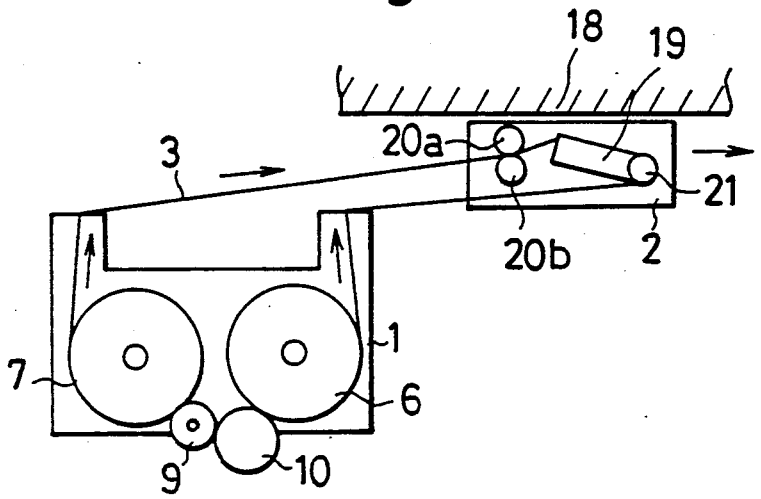

At time t6, when a printing blank signal is fed, as shown in the graph (b), the head motor rotates the print head 19 in the direction to be separated from the platen 18. The quantity of rotation at this time is, as obvious from the graph (b), about half of the usual rotation, and the printing electrode part of the print head 19 is slightly spaced from the recording paper 28 as shown in FIG. 4. At the same time, the ribbon control motor 8 stops rotating. In consequence, as shown in the graph (a), the carriage 2 is moved in the printing direction as indicated by the arrow in FIG. 4 by the rotation of the printing motor 14, and, at this time, since the both control rollers 20*a*, 20*b* are holding and fixing the ink ribbon 3, the ink ribbon 3 is drawn out from the both reels 4, 5. That is, a ribbon skip action is effected, and the ink ribbon 3 is saved. When this ribbon skip action ends at time t7, the head motor rotates as shown in the graph (b), and the printing electrode part of the print head 19 is pressed again, as the head motor rotates, to the recording paper 28 by way of the ink ribbon 3, and a small voltage is applied to the ribbon control motor 8 at time t8, and tension is applied again to the both reels 4, 5, thereby continuing the printing action.

Figure 5:
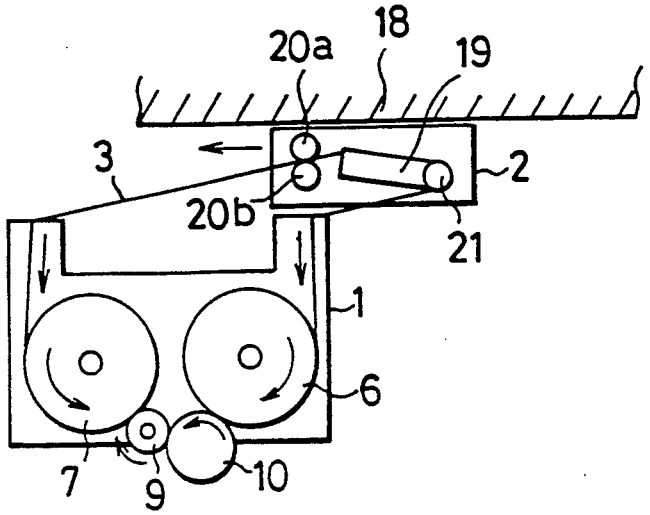

At time t9, when the carriage 2 reaches the printing end position, the rotation of the printing motor 14 stops as shown in the graph (a), and at time t10 the head motor rotates slightly as shown in the graph (b) to space the print head 19 slightly from the recording paper 28 as shown in FIG. 5, so that the rotation of the ribbon control motor 8 stops. Next, at time t11, as shown in the graph (c), the ribbon control motor 8 is rotated by a specified rotating force, and immediately at time t12 the printing motor 14 is rotated reversely to return the carriage 2 as shown in FIG. 5. At this time, both control rollers 20*a*, 20*b* are pinching and fixing the ink ribbon 3, and the unused and used ink ribbons are taken up on the both reels 4, 5. By the home position sensor 27, at time t13, the rotation of the printing motor 14 is stopped as shown in the graph (a), and later at time t14 the rotation of the ribbon control motor 8 stops as shown in the graph (c). At time t15, the head motor rotates as shown in the graph (b) to move the print head 19 to the specified position, thereby opening a specified space against the recording paper 28, and at time t16 the paper feed motor 22 rotates as shown in the graph (d), and the recording paper 28 is fed.

The structure of the cassette mounting portion 29 and the carriage 2 will be explained in more detail hereinafter with reference to FIG. 8 to 13.

Figure 8:
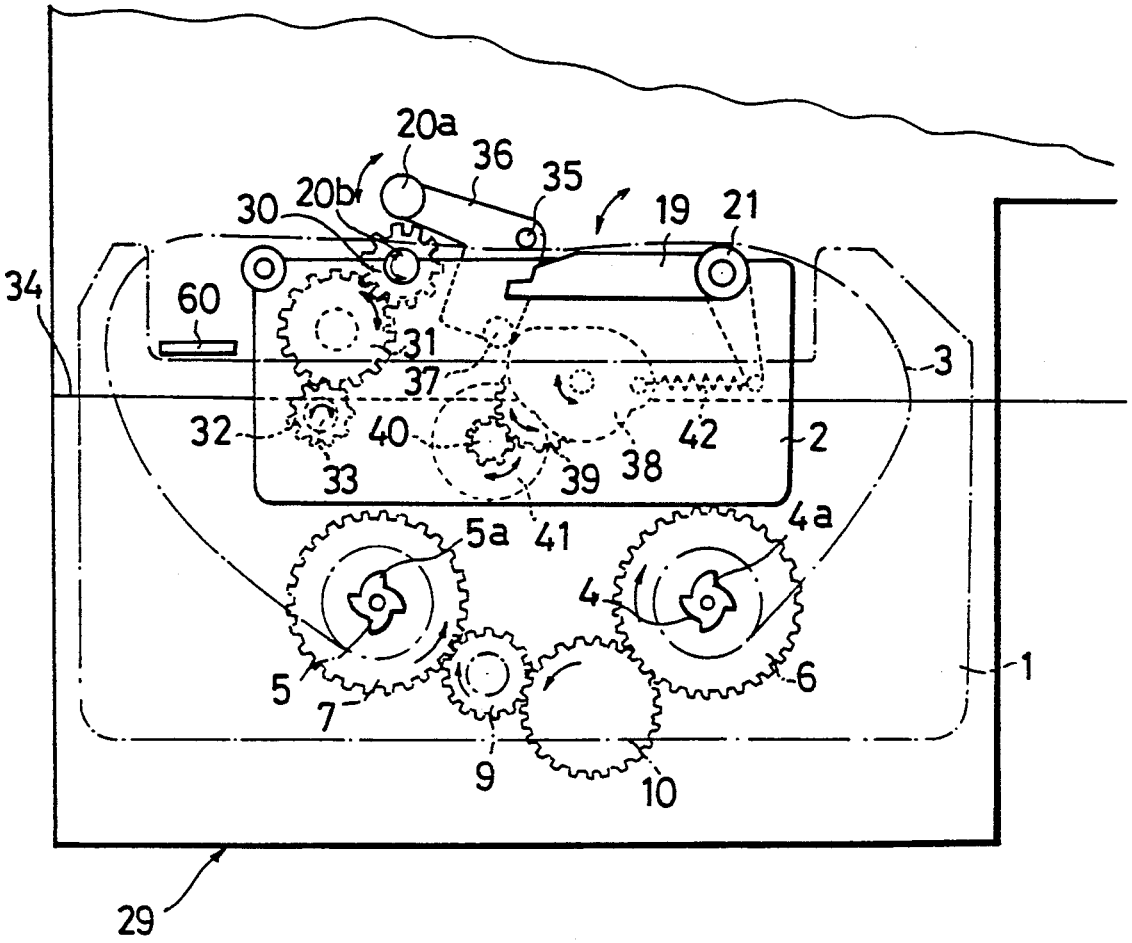

In FIG. 8, the control roller 20*b* is formed body with a gear 30. The gear 30 is connected to a gear 32 of a wire pulley 33 via an intermediate gear 31.

Figure 9:
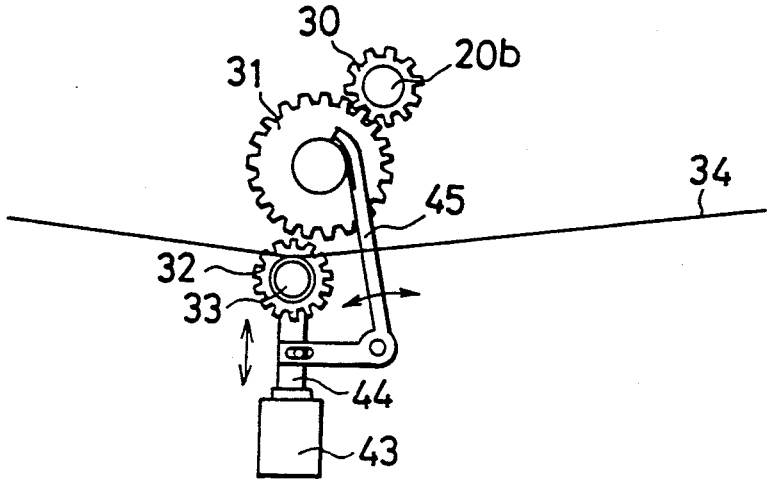

A wire 34 is wound around the pulley 33 by one turn as clearly shown in FIG. 9. The wire 34 is fixed at both ends thereof to the main body of the printer. Thus, in response to the movement of the carriage 2 in right and left directions, the pulley 33 rotates by the effect of the wire 34, and this rotation is transmitted to the control roller 20*b* via the gears 32, 31, and 30.

The above described structure of the carriage 2 enables to transfer the ink ribbon 3 to the print head 19 in a length corresponding to the printing portion of every printing when the ink ribbon 3 is pinched between the control rollers 20*a* and 20*b*.

On the other hand, the other control roller 20*a* is attached to one end of a L-shaped plate 36 which is connected to the lower frame of the carriage 2 rotatably around a shaft 35. The L-shaped plate 36 is provided with a pin 37 at the other end thereof. The pin 37 abuts to the circumference of a cam 38. The L-shaped plate 36 is loaded by a spring (which is not shown) so as to rotate anti-clockwise.

The cam 38 is connected to a head motor 41 via gears 9, and 40, and further connected to the print head 19 via a spring 42 as shown in FIG. 8.

FIG. 8 shows the carriage 2 in a condition that the control rollers 20*a* and 20*b* are apart from each other which allows the ink ribbon 3 to be easily set therebetween on initial loading.

Figure 10:
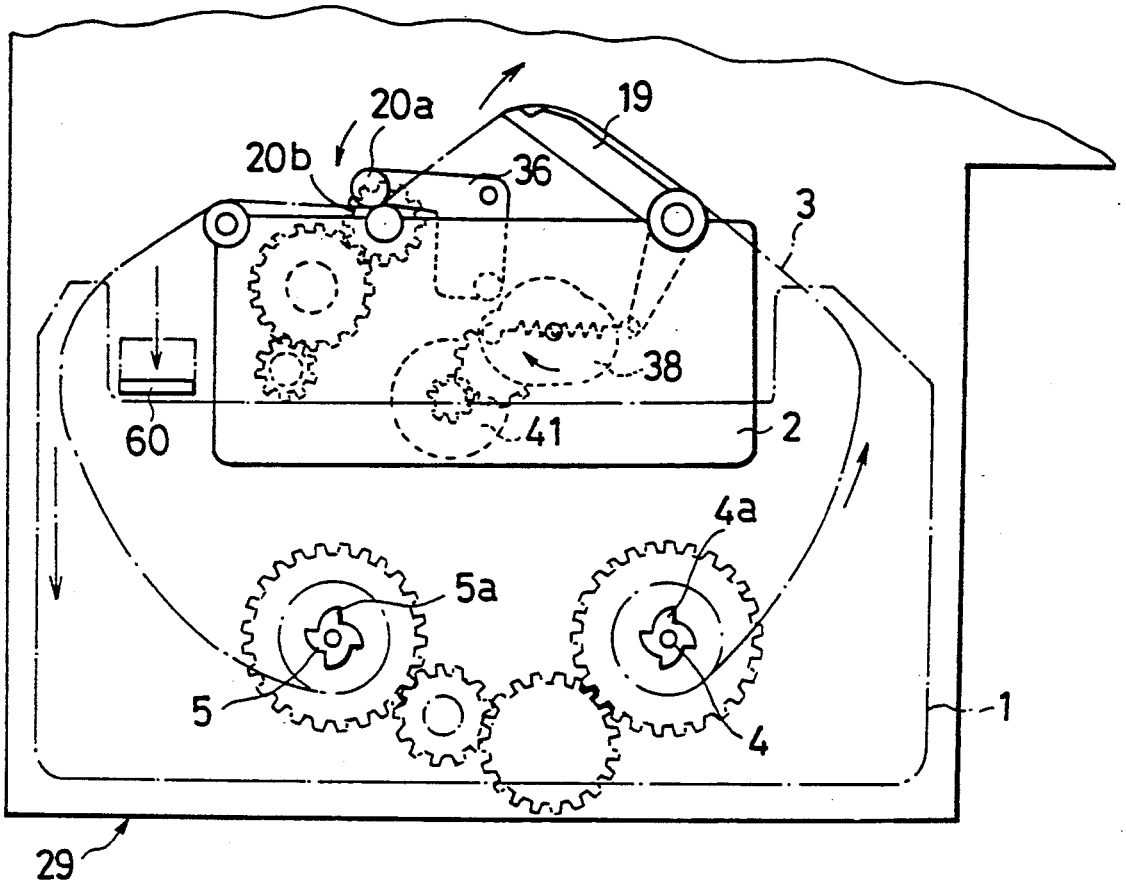

FIG. 10 shows the carriage 2 in a condition that the control rollers 20*a* and 20*b* are abut to each other so as to pinch the ink ribbon 3 which allows the ink ribbon 3 to move in response to the rotation of the control rollers 20*a* and 20*b*.

The shape of the cam 38 is adapted such that the cam 38 is rotated by the rotation of the head motor 41, and, by this rotation, the print head 19 is turned toward the platen (clockwise) and, at the same time, the L-shaped plate 36 is turned anti-clockwise so that the control roller 20*a* abuts to the control roller 20*b* as shown in FIG. 10.

Accordingly, by controlling the rotation of the head motor 41, both of the movement of the print head 19 forward and backward with respect to the platen and the movement of the control roller 20*a* forward and backward with respect to the control roller 20*b* can be controlled.

FIG. 9 also shows the structure of the carriage 2 to selectively gripping the ink ribbon 3 by the control rollers 20*a* and 20*b* during the returning movement and the ribbon skip movement of the carriage 2.

In FIG. 9, a solenoid 43 is equipped in the carriage 2. The wire pulley 33 is rotatably connected to one end of an actuator 44 of the solenoid 43. A L-shaped brake member 45, which is rotatably connected to the frame of the carriage 2 at the central portion thereof, is slidably connected at one end thereof to the intermediate portion of the actuator 44. The other end of the brake member 45 is provided with a felt portion opposing to the shaft of the intermediate gear 31.

In a normal state in which the actuator 44 is not actuated by the solenoid 43, the gear 32 is engaged with the gear 31 while the felt portion of the brake member 45 is spaced from the shaft of the gear 31 as shown in FIG. 8 and 10. When the solenoid 43 is operated to move the actuator 45 downward, the gear 32 is disengaged from the gear 31, and simultaneously, the felt portion of the brake member 45 is abut to the shaft of the gear 31 as shown in FIG. 9. Thus, in this state, even if the carriage 2 is moved in right and left directions, the rotation of the wire pulley 33 is not transmitted to the control roller 20*b*, and moreover, the rotation of the control roller 20*b* is forced to be stopped by the effect of the brake member 45.

As described above, the carriage 2 can perform a selective gripping operation of the ink ribbon 3 to hold the ink ribbon 3 stationary relative to the print head 19 during the returning movement and the ribbon skip movement of the carriage 2.

In FIG. 8 and 10, a lever 60 is shown, which protrudes from the cassette mounting portion 29 for retracting the ribbon cassette 1 downward, namely from the position shown in FIG. 8 to the position shown in FIG. 10. In the position shown in FIG. 8, the ribbon cassette 1 is set to the printer at the cassette mounting portion 29, then the ribbon cassette 1 is retracted downward by the lever 60 such that the cassette 1 is out of the way of the carriage 2.

This retracting structure of the ribbon cassette 1 by use of the lever 60 will be explained later with reference to FIG. 13.

The driving mechanism of the reels 4 and 5 will be explained in more detail hereinbelow with reference to FIG. 11 and 12.

Figure 11:
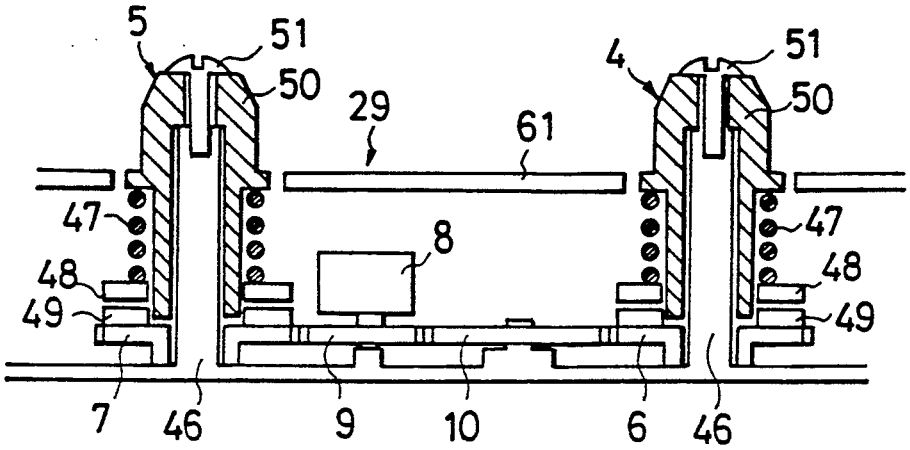

In FIG. 11, the feed reel 4 and the take-up reel 5 have a same structure in which a boss 46 standing from the lower frame of the cassette mounting portion 29 is inserted into the reel main body 50 (hatched section) and fixed by a screw 51. Each main body 50 is provided with each fingers 4*a*, 5*a* as shown in FIG. 8. The clutch plate 48 abuts to a felt member 49 formed in one body with each gear 6, 7 in an elastic way by a spring 47.

Figure 12:
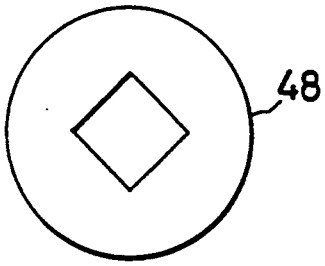

As shown in FIG. 12, the clutch 48 is provided with an aperture of a square shape at a central portion thereof, while the cross section of the reel main body 50 at the level of the clutch 48 is also formed in a same square shape. Thus, the clutch 48 can move along the axis of the reel main body 50 but cannot rotate around this axis.

In FIG. 11, the gear 9 of the take-up motor 8 is engaged with the gear 7 of the take-up reel 5 and also linked with the gear 6 of the feed reel 4 via the gear 10. Accordingly, when the take-up motor 8 rotates clockwise, the generated torque is transmitted to both of the feed reel 4 and the take-up reel 5 to rotate both of these reels 4 and 5 in taking up directions as shown in FIG. 8 by the arrows. The spring 47 is selected in its loading strength such that, if the rotation of the reel 4, 5 is forced to be stopped for some reason, the clutch 48 slips on the felt 49 so as not to load the motor 8.

The retracting mechanism of the cassette mounting portion 29 will be explained next with reference to FIG. 13.

Figure 13A:
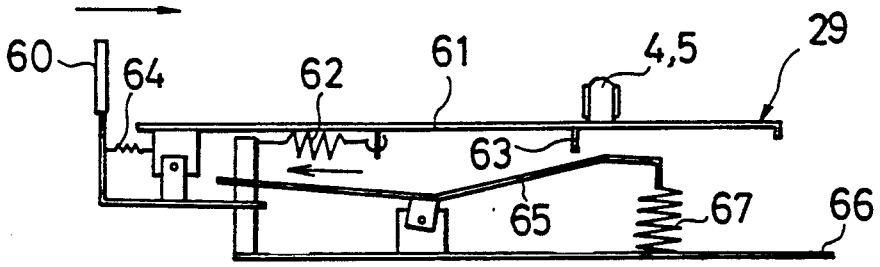
Figure 13B:
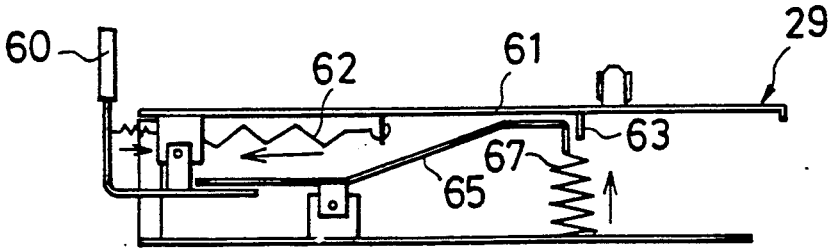

FIG. 13A shows the lever 60 with its driving mechanism in a state corresponding to FIG. 8, while FIG. 13B shows the same in a state corresponding to FIG. 10.

In FIG. 13, the cassette loading plate 61 for setting the cassette thereon is movable in right and left directions and is always loaded in the left direction by a spring 62 with respect to a base frame 66 of the cassette mounting portion 29. The cassette loading plate 61 is provided with a projection member 63. The lever 60 is rotatably attached to the cassette loading plate 61 and loaded clockwise by a spring 64.

A lock lever 65 is rotatably attached to the base frame 66 at the central portion thereof as shown in FIG. 13. The lock lever 65 is prescribed in its length such that the left end thereof is positioned above the tip portion of the lever 60. The right end of the lock lever 65 is bent in a L-shape and always loaded upward by a spring 67.

In the state of FIG. 13A, the cassette can be loaded on the cassette loading plate 61 which is in the cassette loading position. At this state, by pressing the lever 60 in the right direction, the cassette loading plate 61 slides in the right direction against the force of the spring 62. Once the projection member 63 goes beyond the L-shaped portion of the lock lever 65, this L-shaped portion is pressed and moved upward by the spring 67, and then engaged with the projection member 63. At this time, by releasing the lever 60, the cassette loading plate 61 becomes stationary to settle in the operating position as shown in FIG. 13B, in which the printer can be in the state ready for printing.

Figure 13C:
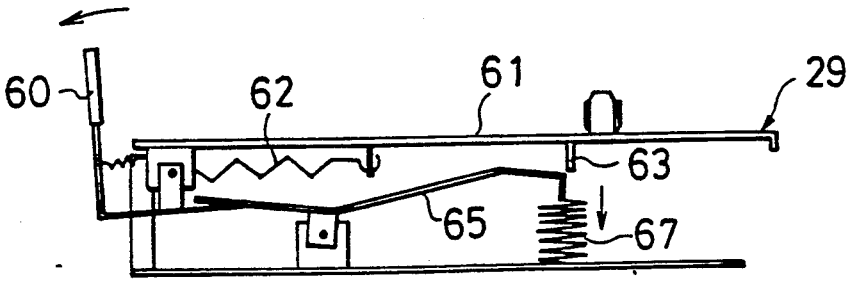

In the state of FIG. 13B, by pressing the lever 60 in the left direction, the lock lever 65 is turned clockwise against the spring 67, and then the L-shaped portion of the lock lever 65 is disengaged from the projection member 63 as shown in FIG. 13C. Then, the cassette loading plate 61 is moved in the left direction by the effect of the spring 62, and finally stops at the position as shown in FIG. 13A.

In the above described embodiment, the lever 60 is pressed manually, however it may be utilized an automatic pressing mechanism by use of a driving means for pressing the lever 60 by an instruction from the cassette detection switch 26 shown in FIG. 2.

It is also possible to equip a detection switch for detecting the position of the loading plate 61 and controlling the head motor 41 by the detected position of the loading plate 61 such that the control rollers 20*a*, 20*b* separate from each other and the print head 19 pivots away from the platen 18 as the loading plate 61 is moved to the loading position, and that the control rollers 20*a*, 20*b* approach each other and the print head 19 pivots towards the platen 18 as the loading plate 61 is moved to the operating position.

As described herein, according to the printer of this embodiment, aside from the advantages of the ribbon cassette fixed type, such as high speed, small size, and use of large-sized ribbon cassette, since the ink ribbon 3 can be transferred by the portion of the printing length by the print head 19 at the time of printing by the newly installed control rollers 20*a*, 20*b*, there is no loss in ribbon take-up, and faster operation is realized, and moreover the ribbon skip action which was difficult in the conventional ribbon cassette type can be easily effected, and the ink ribbon 3 can be saved, so that great economical effects can be obtained.

With above described remarkable feature, the printer of this embodiment is very advantageous in that the ribbon cassette 1 can be loaded easily and the printer can be made in a state able to print by loading the ribbon cassette 1, moving the lever 60 and driving the head motor 41.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a main body;

a cassette mounting portions provided on said main body and having a cassette loading plate;

a ribbon cassette detachably mounted on said loading plate, and including two spools generally in parallel winding an ink ribbon therebetween;

a feed reel disposed at said loading plate and adapted to engage with one of said spools for feeding said ribbon;

a take-up reel disposed at said loading plate and adapted to engage with the other of said spools for taking-up said ribbon;

a carriage mounted in said main body movably along a platen;

a print head disposed on said carriage and adapted to pivot on said carriage away from and toward said platen, to which a portion of said ribbon is positioned, for printing by using said ribbon discharged from said cassette by a movement of said carriage along said platen; and moving means provided on said mounting portion for moving said loading plate to a loading position near said platen, in which said cassette is positioned in the vicinity of said carriage so as to positioned said portion of said ribbon to said head along with a loading motion of said cassette while said head is away from said platen, and an operating position far from said platen, in which said cassette is positioned away from said carriage so as not to disturb said movement of said carriage.

2. The printer according to claim 1, further comprising:

reel control means connected with said reels for applying a small torque, of such an extent to slip with respect to a ribbon discharging force generated by said movement of said carriage in said printing direction, to each of said reels at every printing action in such a direction as to wind said ribbon on each of said spools, and applying a large torque to each of said reels at a carriage returning action in such a direction as to wind said ribbon on each of said spools.

3. The printer according to claim 1, further comprising a cassette detection switch for detecting that said cassette is loaded on said loading plate.

4. The printer according to claim 1, further comprising:

a pair of control rollers, disposed on said carriage and adapted to separate from each other and approach each other to pinch said ribbon therebetween, for transferring and fixing said ribbon therebetween by controlling a rotation thereof, said rollers being adapted such that said ribbon can be set between said separated rollers along with said loading motion of said cassette when said loading plate is in said loading position, and said ribbon is pinched between said rollers when said loading plate is in said operating position.

5. The printer according to claim 4, wherein said rollers are adapted to transfer said ribbon in a length corresponding to said movement of said carriage in said printing direction by rotating at every printing action and fix said ribbon therebetween by non-rotating at a carriage returning action and a ribbon skipping action.

6. The printer according to claim 4, wherein said rollers and said head are linked with each other such that said rollers separate from each other as said head pivots to said one position, and that said rollers approach each other as said head pivots to said another position.

7. The printer according to claim 4, further comprising:

reel control means connected with said reels for applying a small torque, of such an extent to slip with respect to a ribbon discharging force generated by said movement of said carriage in said printing direction, to each of said reels at every printing action in such a direction as to wind said ribbon on each of said spools, and applying a large torque to each of said reels at a carriage returning action in such a direction as to wind said ribbon on each of said spools.

8. The printer according to claim 4, further comprising a cassette detection switch for detecting that said cassette is loaded on said loading plate.

* * * * *